US010858847B2

(12) United States Patent
Erickson

(10) Patent No.: US 10,858,847 B2
(45) Date of Patent: Dec. 8, 2020

(54) FASCIA MOUNTING SYSTEM

(71) Applicant: Russell Erickson, Blaine, MN (US)

(72) Inventor: Russell Erickson, Blaine, MN (US)

( * ) Notice: Subject to any disclaimer, the term of this patent is extended or adjusted under 35 U.S.C. 154(b) by 0 days.

(21) Appl. No.: 16/700,538

(22) Filed: Dec. 2, 2019

(65) Prior Publication Data

US 2020/0173180 A1 Jun. 4, 2020

Related U.S. Application Data

(60) Provisional application No. 62/774,598, filed on Dec. 3, 2018.

(51) Int. Cl.
*E04F 19/06* (2006.01)
*E04D 13/15* (2006.01)

(52) U.S. Cl.
CPC ..... *E04F 19/06* (2013.01); *E04D 13/15* (2013.01)

(58) Field of Classification Search
CPC ..... E04F 19/06; E04D 13/15
See application file for complete search history.

(56) References Cited

U.S. PATENT DOCUMENTS

| | | | | |
|---|---|---|---|---|
| 4,189,885 | A * | 2/1980 | Fritz | E04F 13/0842 52/278 |
| 5,388,379 | A * | 2/1995 | Lamberti | E04D 13/15 52/300 |
| 7,591,118 | B2 * | 9/2009 | Shaw | E04D 13/15 52/287.1 |
| 7,743,581 | B2 * | 6/2010 | Shaw | E04D 13/15 52/741.1 |
| 9,284,734 | B1 * | 3/2016 | Inzeo | E04D 13/155 |
| 10,267,045 | B1 * | 4/2019 | Knight, Jr. | E04F 13/12 |
| 10,280,633 | B2 * | 5/2019 | Schlueter | F21S 4/20 |
| 2013/0055651 | A1 * | 3/2013 | Garcia | E04F 19/061 52/58 |
| 2020/0173180 | A1 * | 6/2020 | Erickson | E04D 13/15 |

* cited by examiner

*Primary Examiner* — Andrew J Triggs
(74) *Attorney, Agent, or Firm* — Vidas Arrett & Steinkraus P.A.

(57) ABSTRACT

A method or system for mounting fascia involving attaching at least two blocks, spaced apart to framing material, the blocks having upper and lower channels facing away from the framing material. Attaching an upper and lower J channel to a piece of fascia material and sliding the fascia material with the J channels into the block channels, then snapping caps over the at least two blocks.

24 Claims, 21 Drawing Sheets

24

FASCIA MOUNTING SYSTEM

CROSS-REFERENCE TO RELATED APPLICATIONS

This Application claims the benefit of and priority to U.S. Provisional Application No. 62/774,598, filed Dec. 3, 2018, the entire contents of which is hereby incorporated by reference.

STATEMENT REGARDING FEDERALLY SPONSORED RESEARCH

Not Applicable.

BACKGROUND OF THE INVENTION

When fascia is directly attached to the framing material, such as by using screws, the different rates of expansion and contraction of the framing and fascia material can cause sheering of the screws and/or wear and tear on the materials which reduce the life of the fascia.

There is a need for a new way of mounting composite, PVC or wood fascia to stairs, decks, balconies, porches or similar structures which allow the fascia to free float over the framing material.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

The invention provides a system and method of mounting fascia. At least two blocks having channels are attached to framing material, with the channels facing outwards from the framing material. There can be corner blocks and intermediate blocks. Upper and lower J channels are attached to the fascia material, which is then slid into the channels of the blocks. Caps are snap fitted over the blocks. For additional support, a J hook can be attached to the framing material between adjacent blocks.

The blocks, J channels, caps and J hooks can be made of metal, such as aluminum, or a metal alloy, plastic or other composite material.

DETAILED DESCRIPTION OF THE INVENTION

Figure 1:
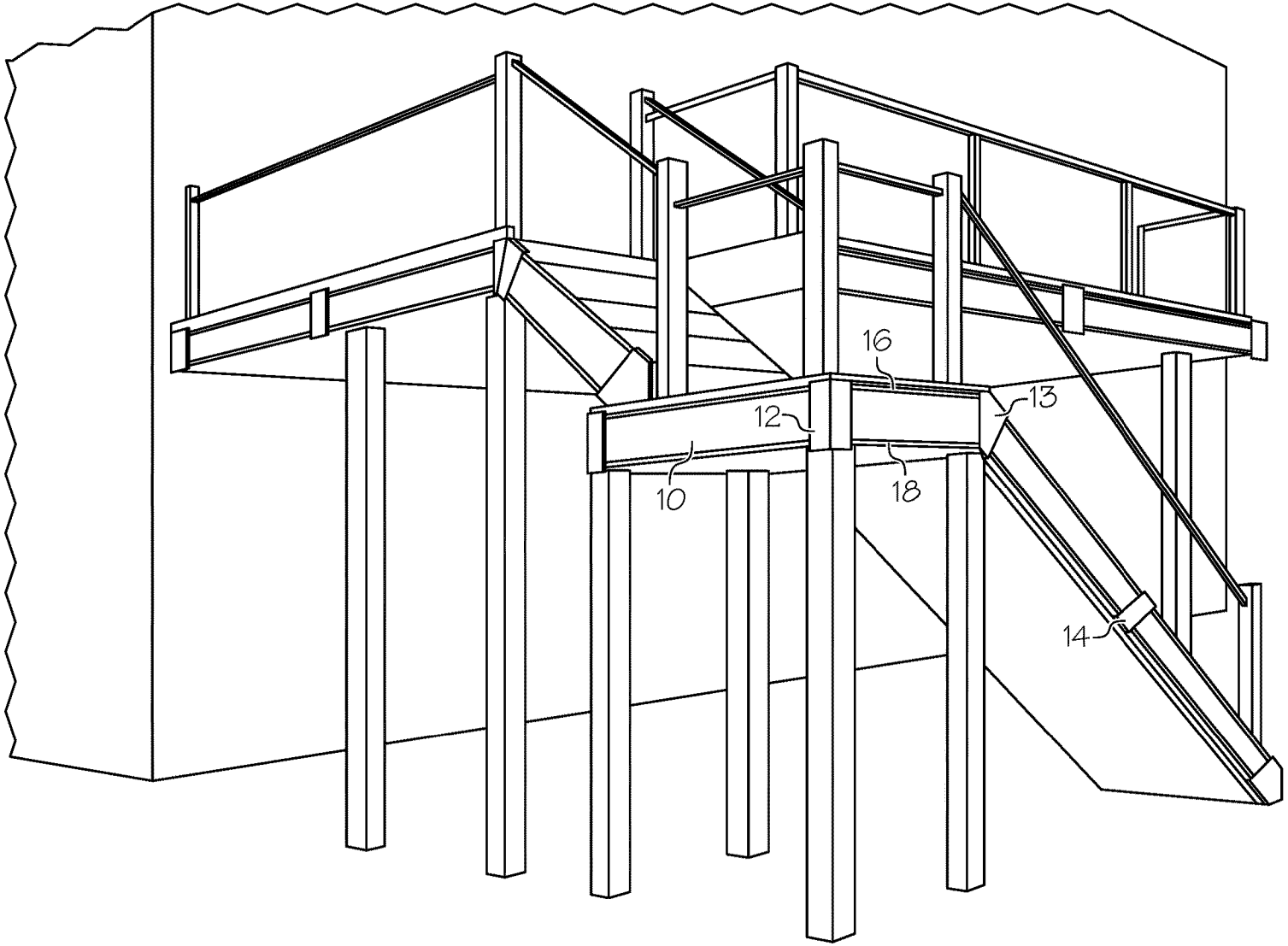
FIG. 1 shows a an installed example of the fascia system, installed on a deck and staircase.

Referring now to FIG. 1, the inventive fascia mounting system is shown installed onto a deck and stairway. A piece of fascia material is shown at 10. A corner cap is shown at 12, and intermediate transition cap is shown at 14, and upper and lower J channels are shown at 16 and 18. A stairway transition cap is shown at 13, which accommodates variable stair pitches.

The fascia can be composite, PVC or wood fascia, and can be installed onto stairs, decks, balconies, porches or similar structures by separate hardware attached to the support surface (framing material) and the fascia. The fascia is then attached to the support framing structure by means of a J channel (16 and 18) providing a free-floating platform of attachment. Additionally, there are transition blocks for joints on inside corners, outside corners and but end joints (best seen in FIG. 3). The entire system is then covered with a cap allowing the underlying support to move with fluctuations in the framing and maintaining the same esthetic. Because it is a "system" for mounting, the fascia parts can be mixed and matched and modified for different situations.

The purpose of the Fascia Mounting System is to create a modular system to reduce labor for installation, decrease wear and tear on materials and extend the life of fascia attached to stairs, decks, balconies, porches and similar structures. The system allows composite, PVC or wood fascia to free float over the framing material. By doing this you allow for the expansion and contraction of framing and fascia material independently. When the fascia is allowed to move, fasteners such as screws will not sheer off increasing the safety of your fascia installation and extending its lifespan. Furthermore, this process conceals joints, does not buckle and hides cut ends allowing for a consistent esthetic throughout the products lifespan.

Four separate pieces of hardware are needed to attach the fascia to the frame of the structure in a free-floating manor. The Four pieces are the Cap (corner or intermediate), Block (corner or intermediate), J Channel (upper and lower) and J Hook. While a preferred embodiment of the four parts are made from aluminum, it should be understood that the parts can be made of any desirable material, such as any metal, alloy, composite or plastic material. The aluminum is shown made from sheets which are folded to form the various parts, but the metal parts could be cast. If plastic parts are used instead of aluminum, they can be molded if desired.

Figure 2:
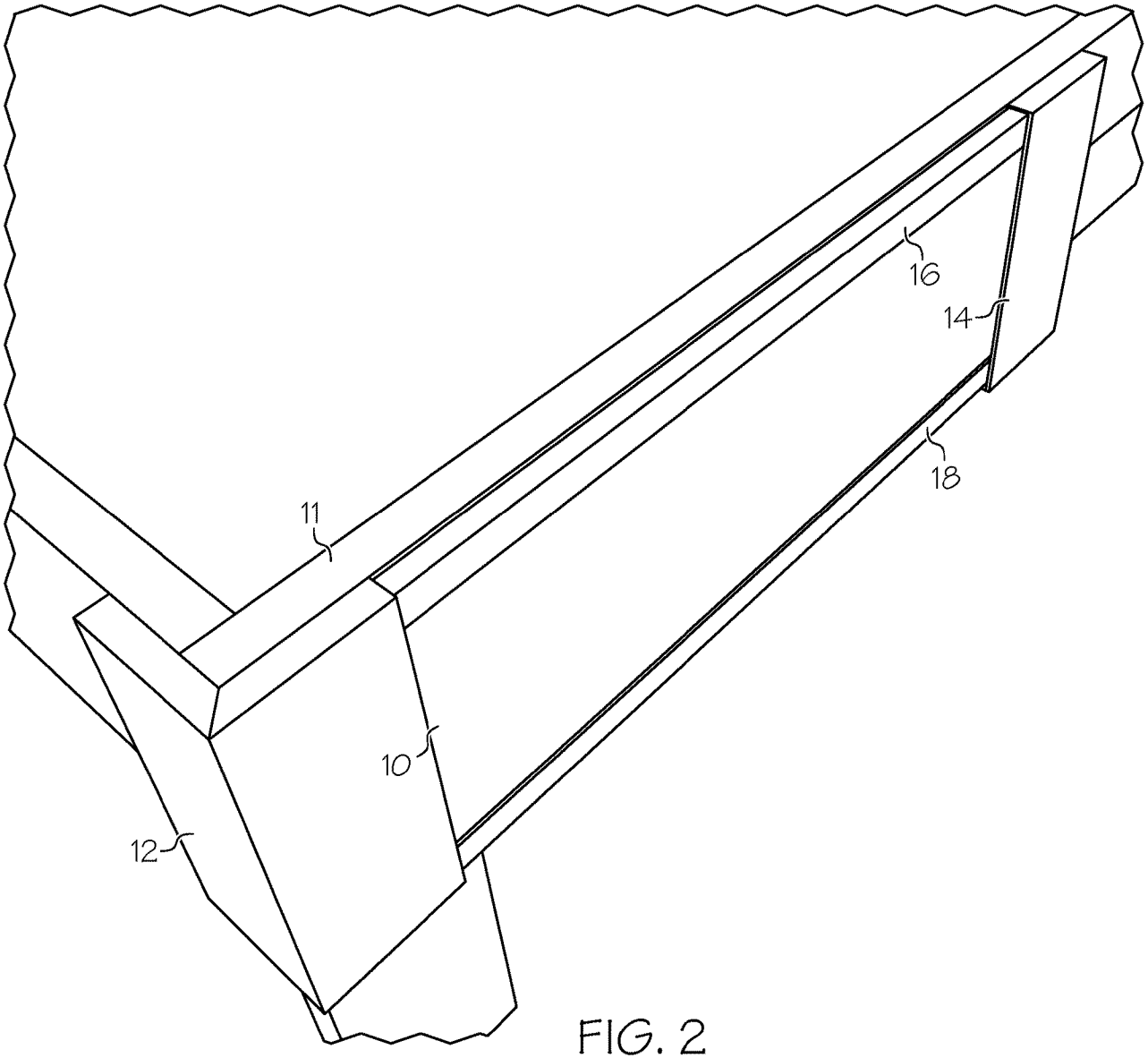
FIG. 2 shows a portion of fascia installed on the framing material.

Referring now to FIG. 2, the framing material is shown at 11, with a corner cap shown at 12, an intermediate cap shown at 15, and upper and lower J channels 16 and 18 and the fascia material 10.

Figure 3:
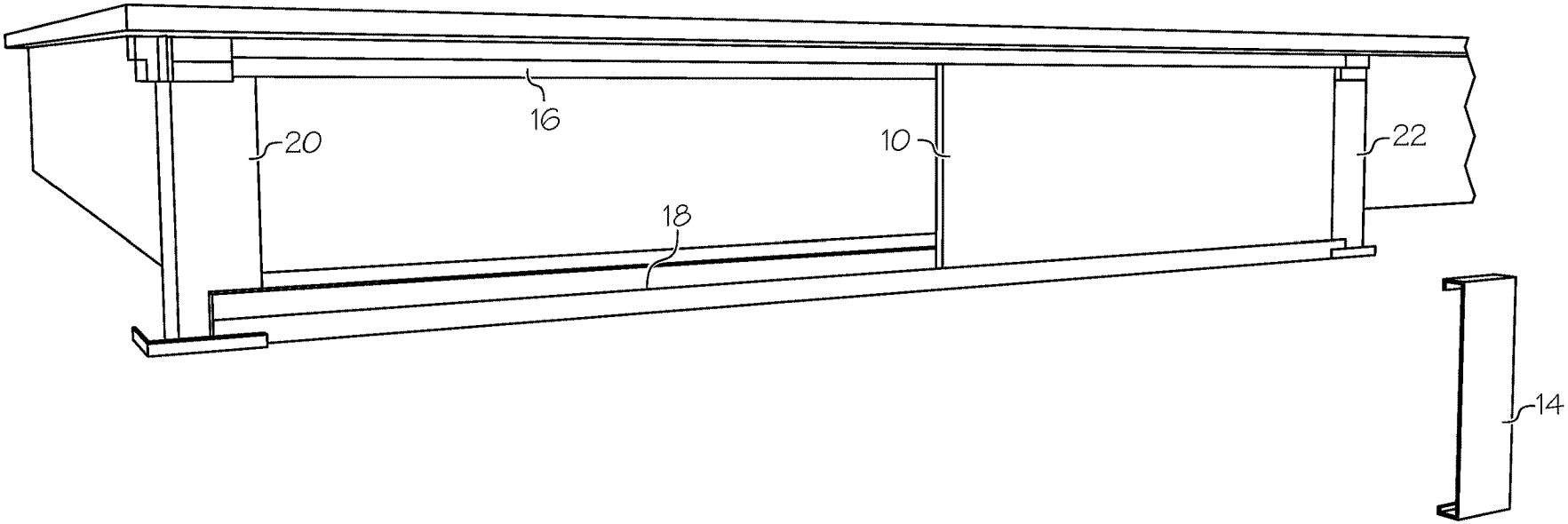
FIG. 3 shows a side schematic view of the parts of the inventive fascia system.
Figure 4:
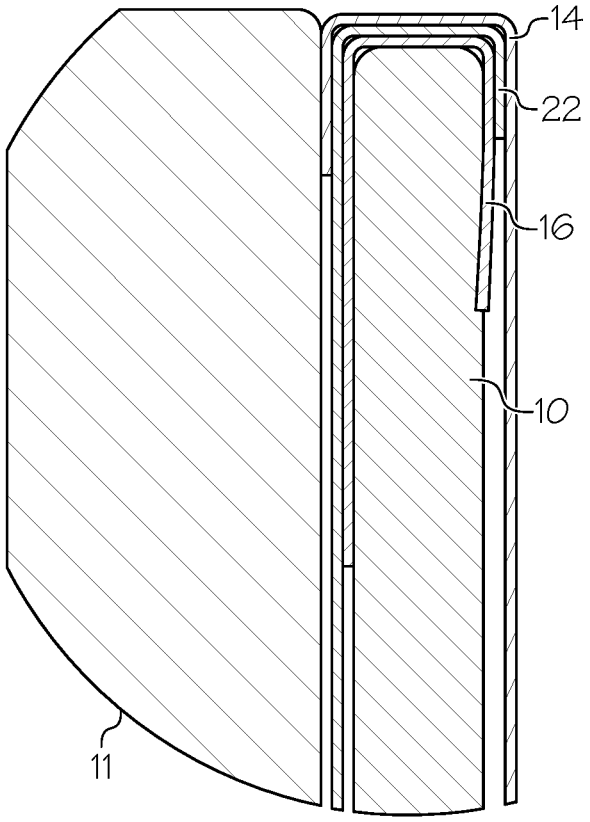
FIG. 4 shows a side cross-sectional view of the upper portion of the fascia system.
Figure 5:
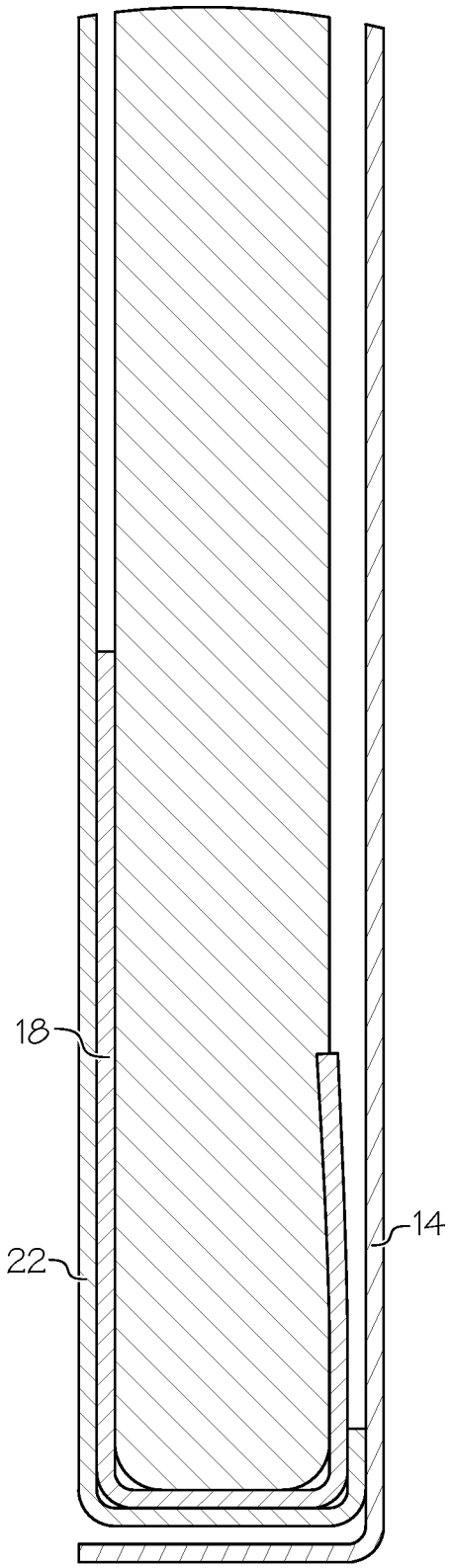
FIG. 5 shows a side cross-sectional view of the lower portion of the fascia system.

Referring now to FIG. 3, the parts of the framing material are shown in more detail, with a corner block shown at 20, an intermediate block shown at 22, the J channels shown at 16 and 18, the fascia shown at 10 and the intermediate cap shown at 14. Referring now to FIGS. 4 and 5, a cross section view of the upper portion of the system (FIG. 4) and the lower portion of the system (FIG. 5) is shown.

Figure 6:
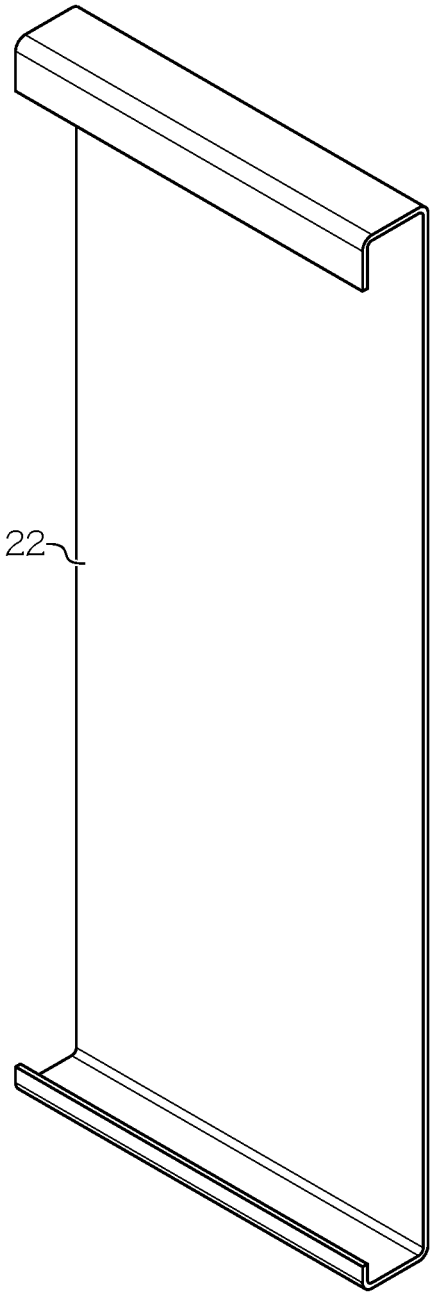
FIG. 6 shows an intermediate block.
Figure 7:
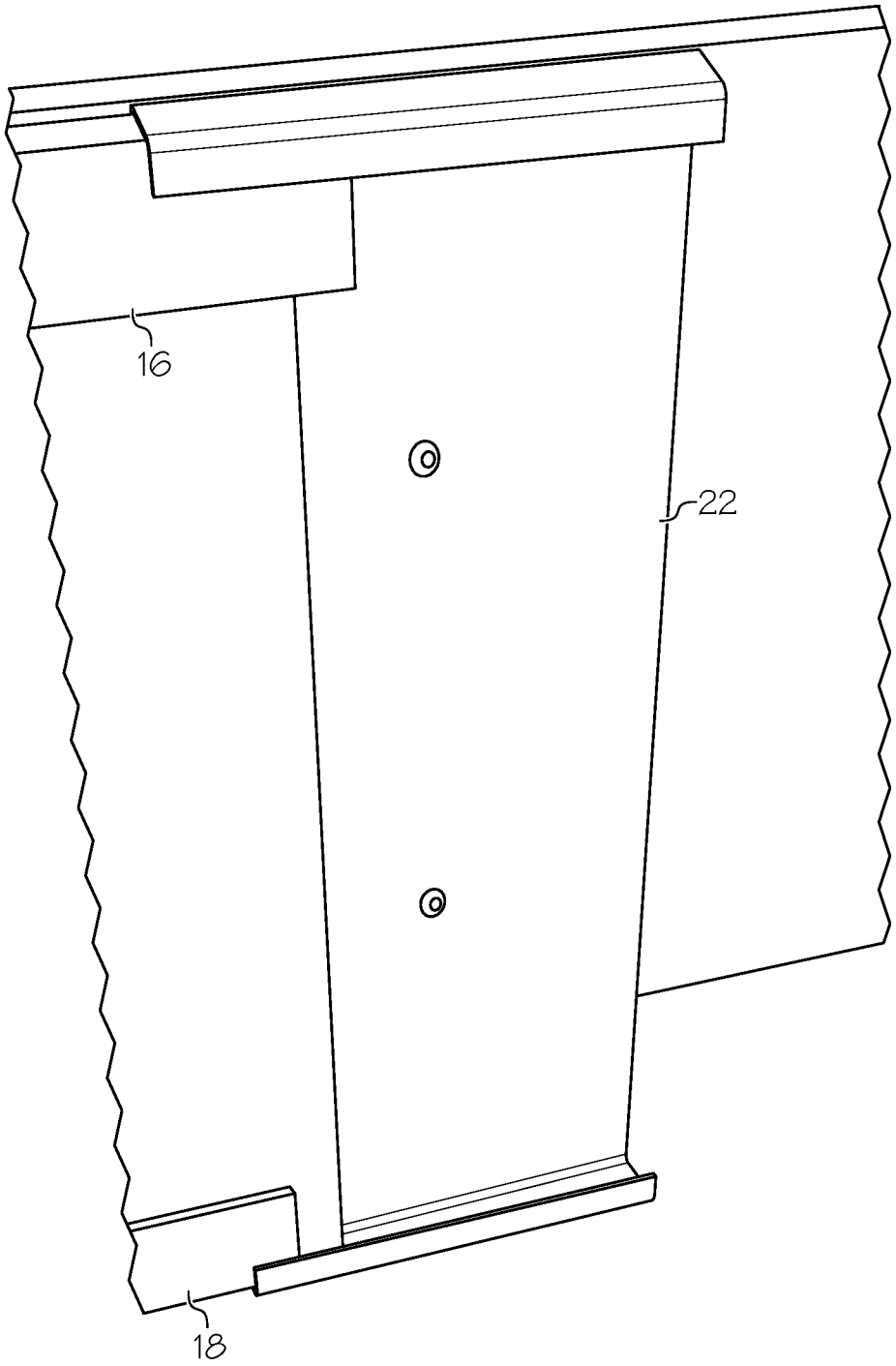
FIG. 7 shows an intermediate block installed onto the framing material.
Figure 8:
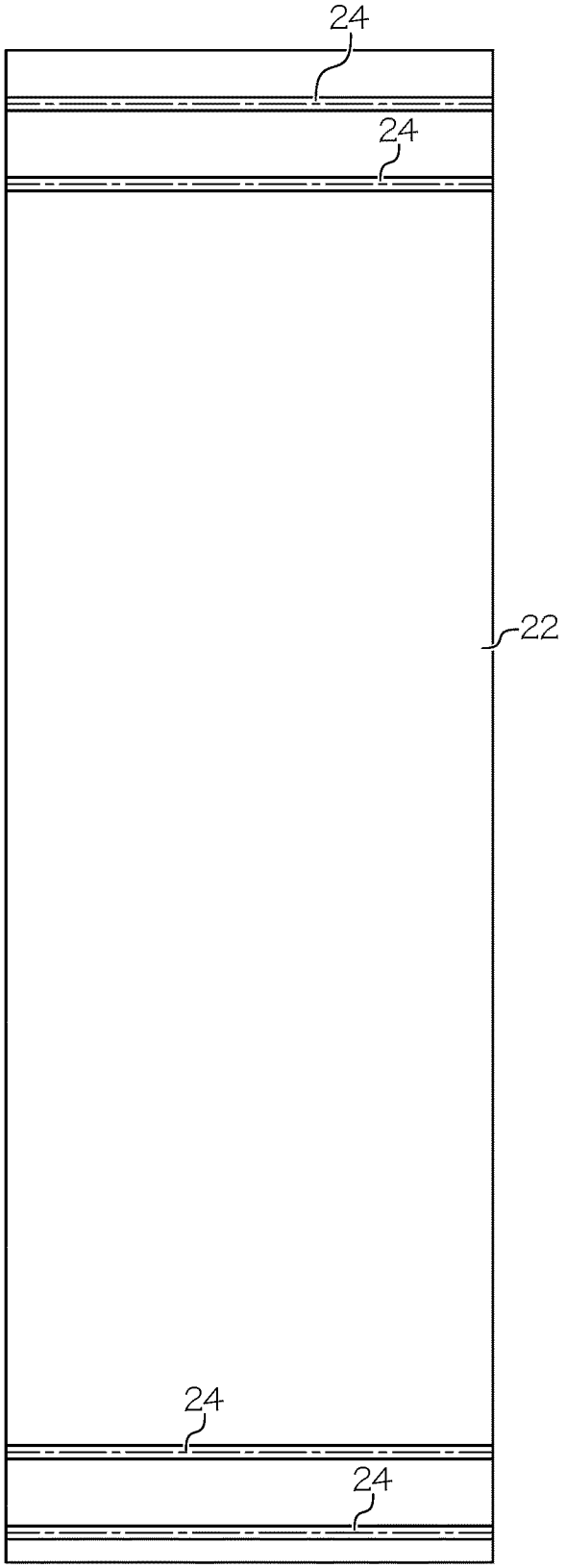
FIG. 8 shows the fold lines necessary to make an intermediate block from a piece of aluminum.

Referring now to FIGS. 6-8, the intermediate block 22 is shown. The intermediate block is attached to frame 11 with the channel facing away. The block 22 is preferably made of a sheet of aluminum material which is bent at the numbered fold lines 24 in FIG. 8.

Figure 9:
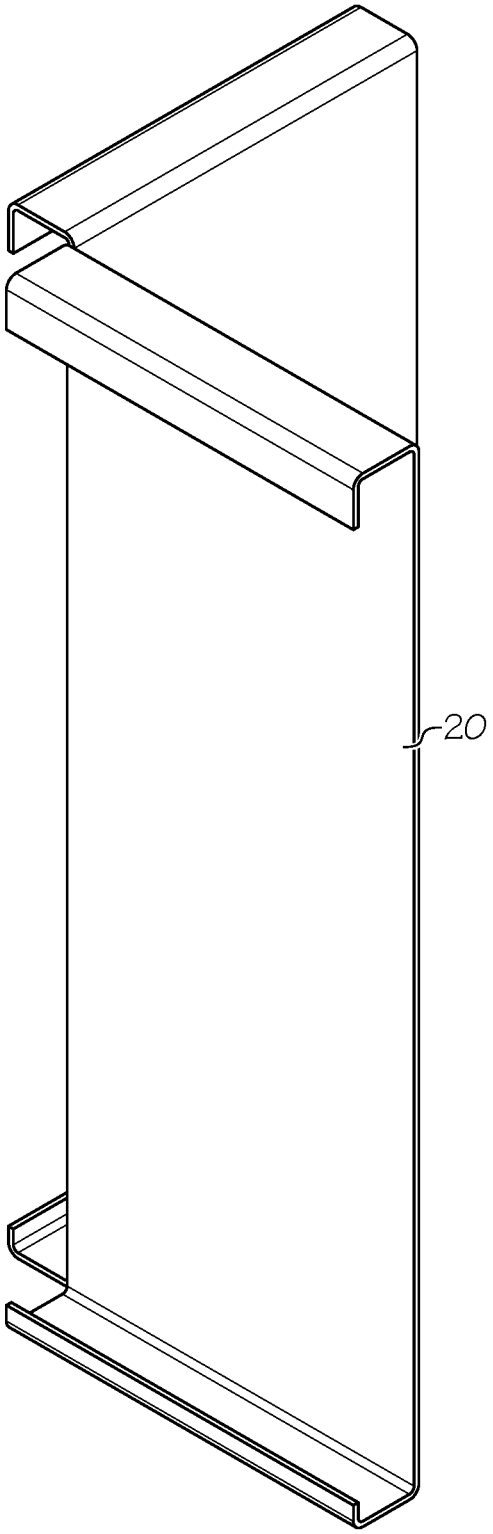
FIG. 9 shows a corner block.
Figure 10:
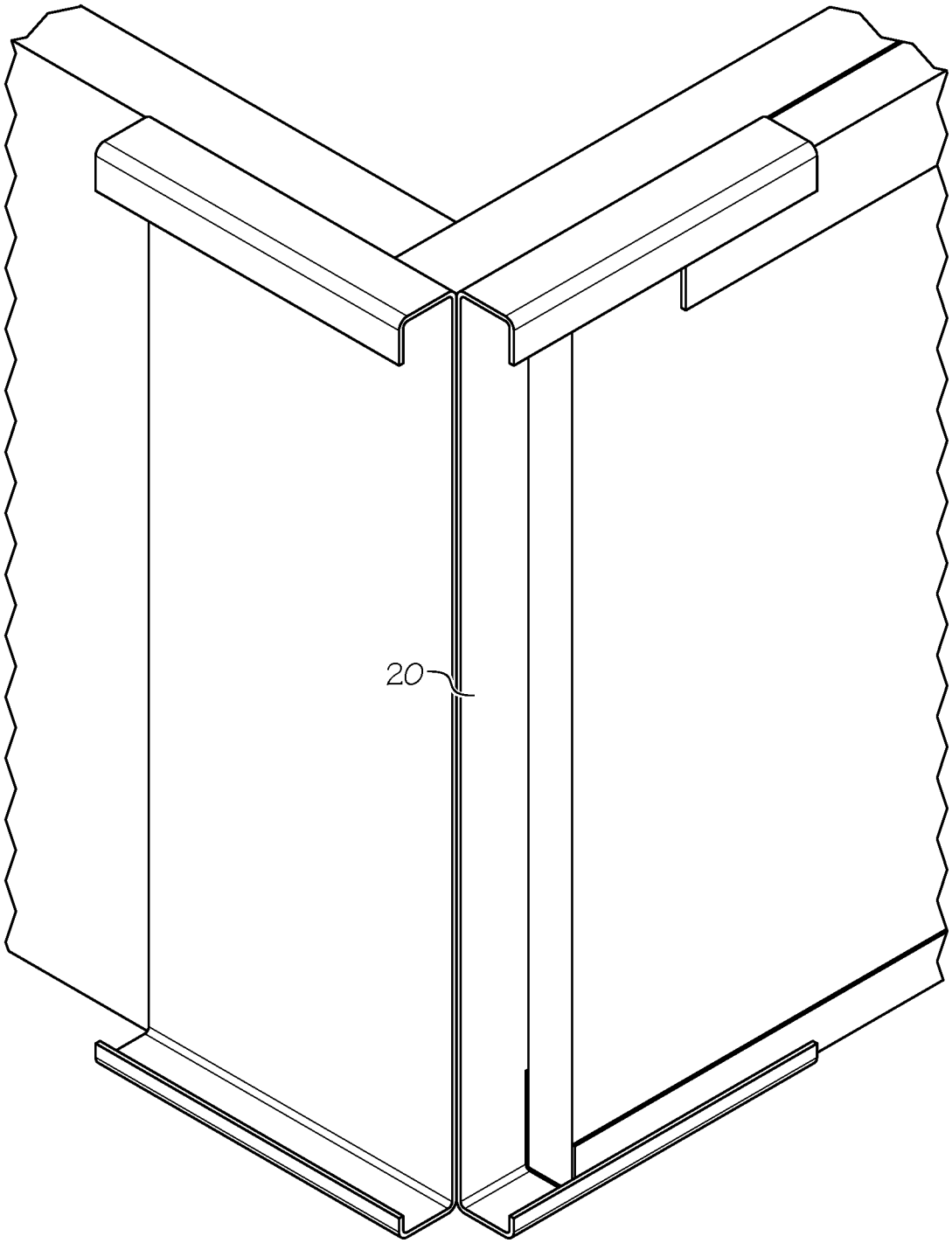
FIG. 10 shows how the corner block installed onto the framing material.
Figure 11:
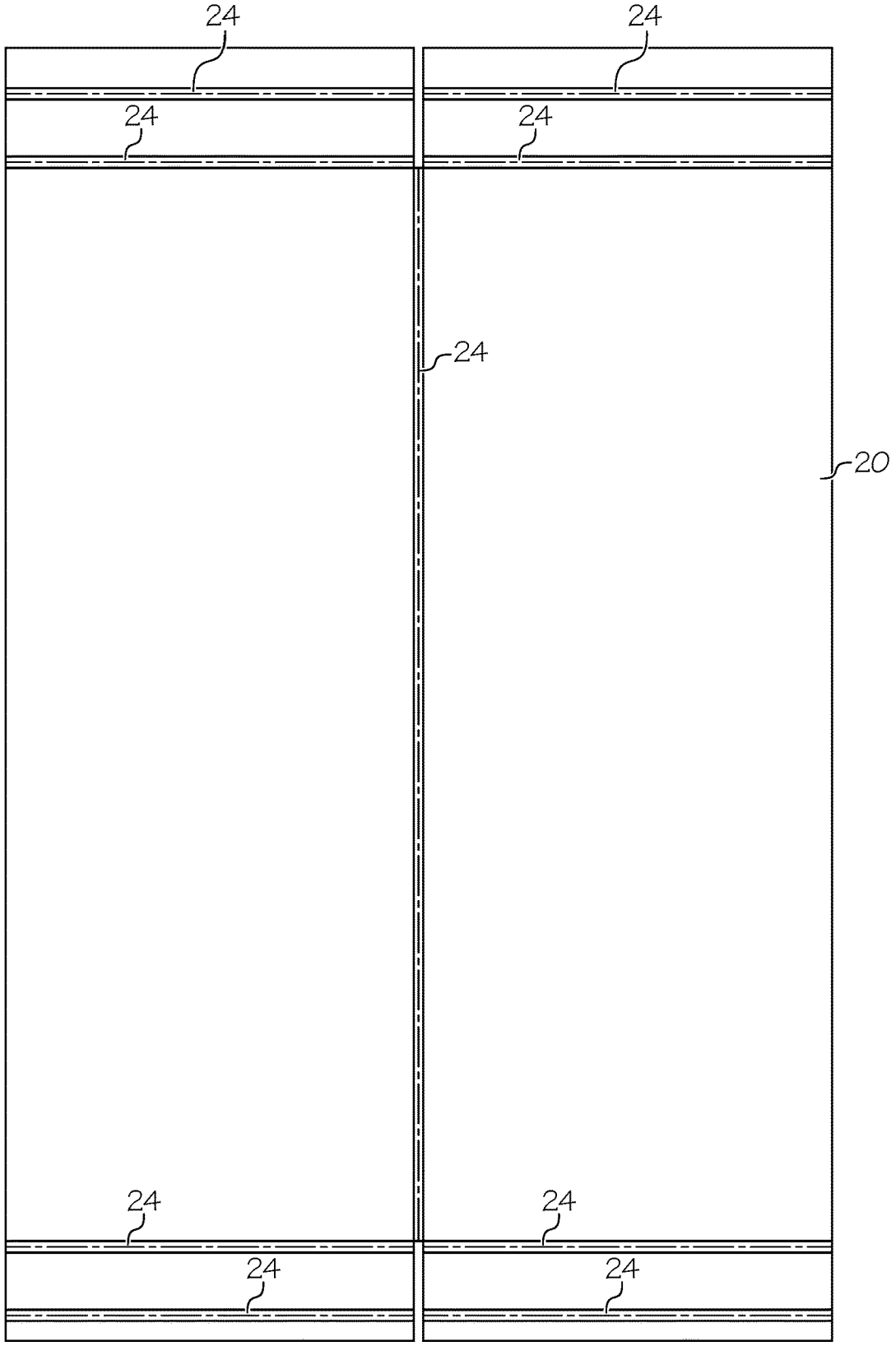
FIG. 11 shows the fold lines necessary to make a corner block from a piece of aluminum.

Referring now to FIGS. 9-11, the corner block 20 is shown. The corner block is attached to frame 11 with the channels facing away. The block 20 is preferably made of a sheet of aluminum material which is bent at the numbered fold lines 24 in FIG. 11.

Other transition blocks and caps are also possible. For example, a stairway transition block/cap are shown in FIG. 1 at 13, which allow the system to accommodate variable stair pitches.

Figure 12:
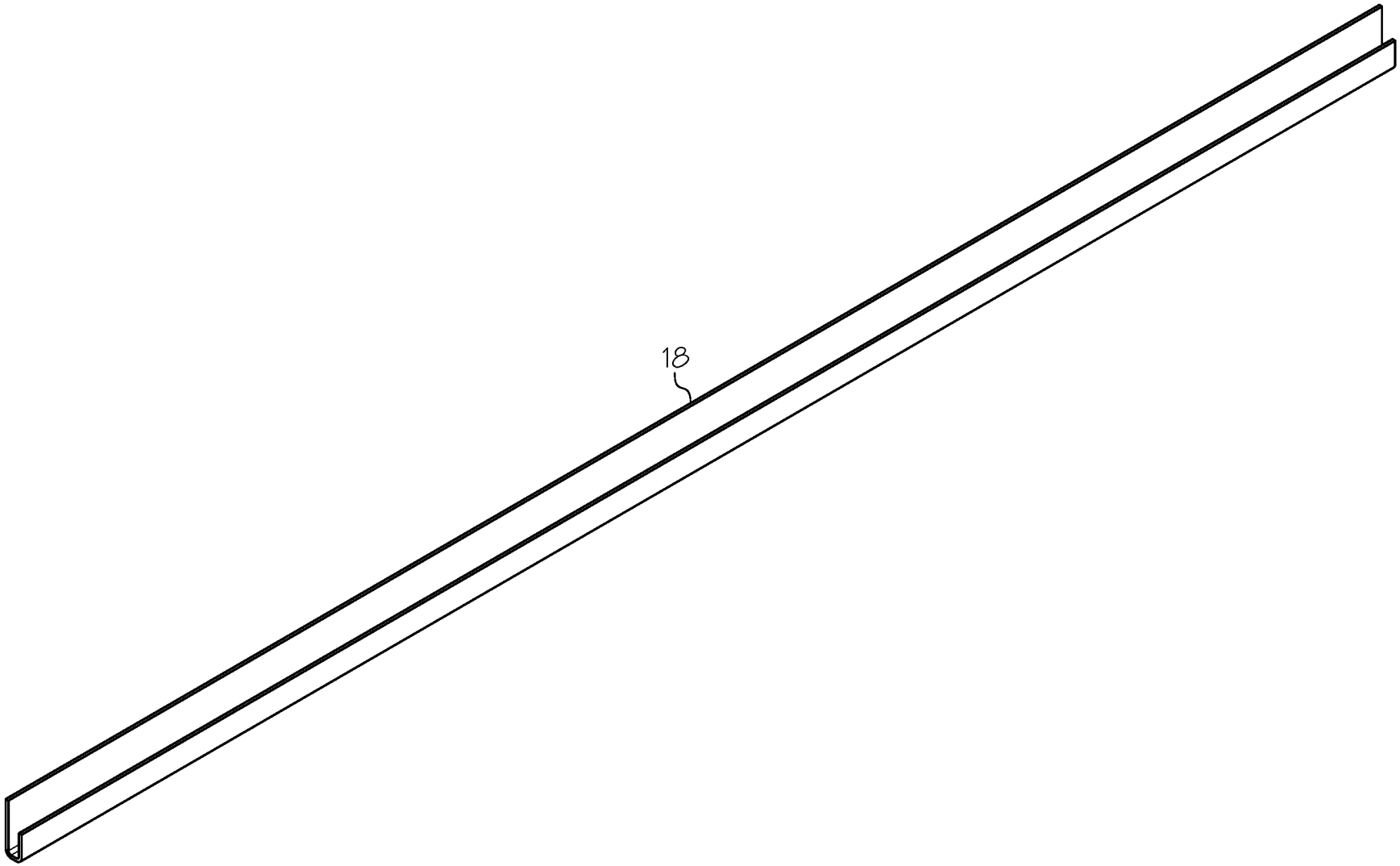
FIG. 12 shows a J channel, which can either be an upper or lower J channel simply by inverting the J channel.
Figure 13:
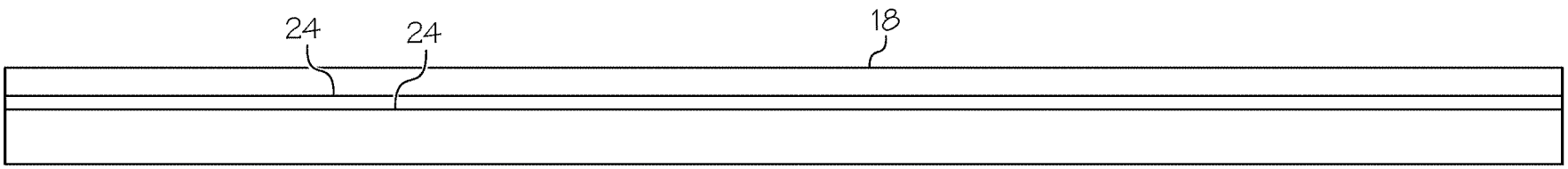
FIG. 13 shows the fold lines necessary to make a J channel from a piece of aluminum.

Referring now to FIGS. 12 and 13, the J channel (16 and 18) is shown.

The J channels are made from a sheet of aluminum material which is bent at the numbered fold lines 24 in FIG. 13. There are two J Channel pieces involved in the assembly. They are the upper J channel 16 and lower J channel 18. Both pieces of hardware are attached to the fascia by off the shelf hardware specific to the fascia material. J Channels are made from cut sheet metal such as aluminum or similar bent twice (FIG. 13).

Figure 14:
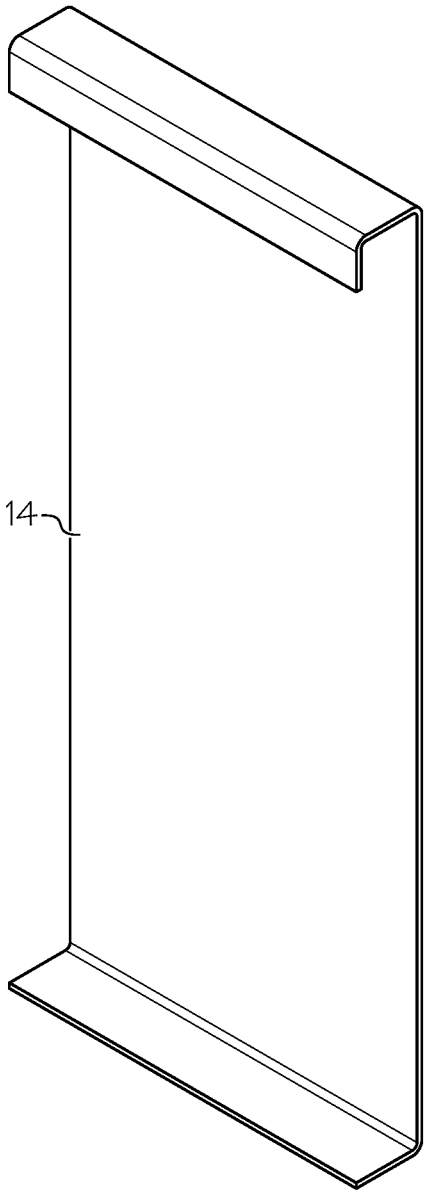
FIG. 14 shows an intermediate cap.
Figure 15:
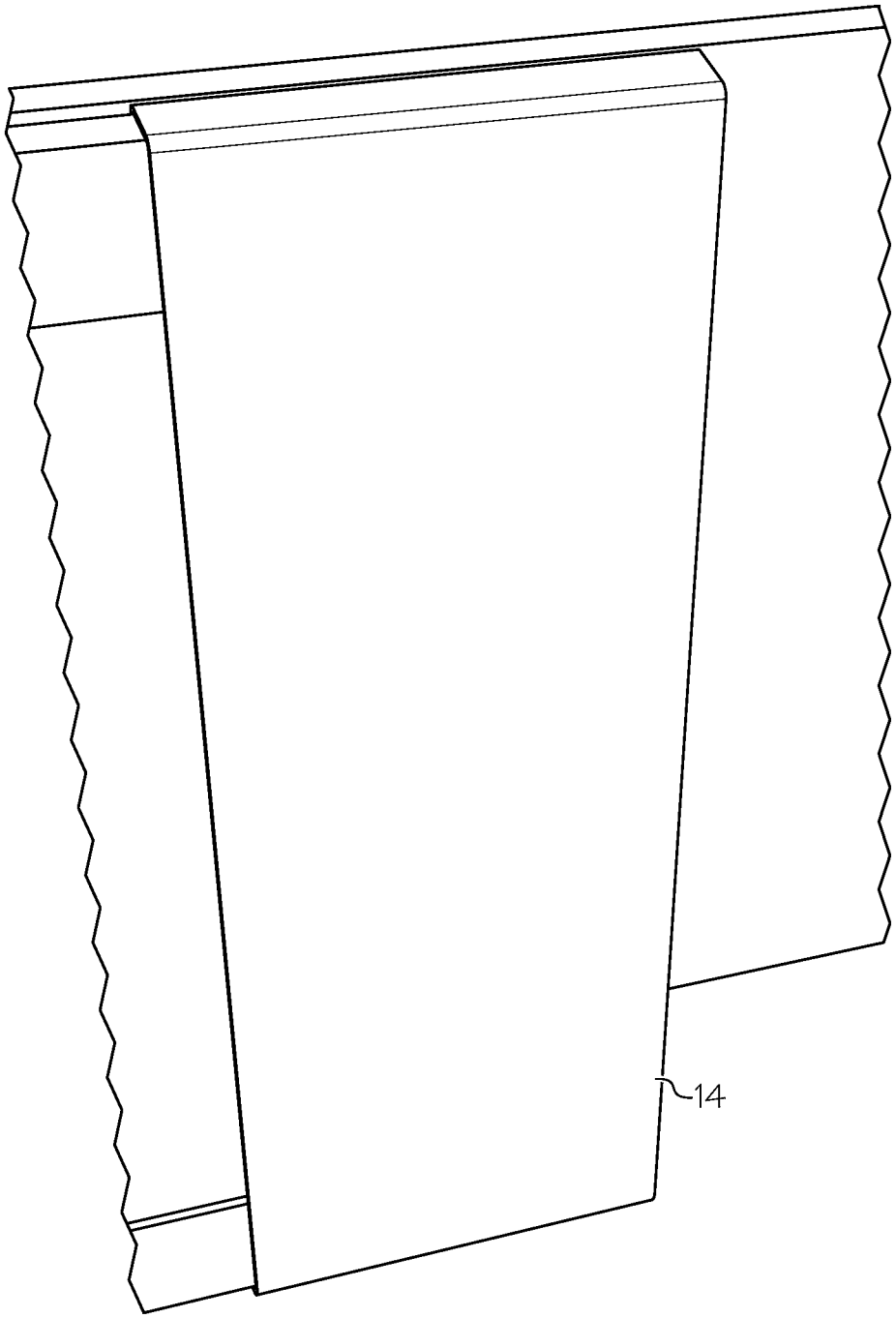
FIG. 15 shows the intermediate cap snap fitted over the intermediate block.
Figure 16:
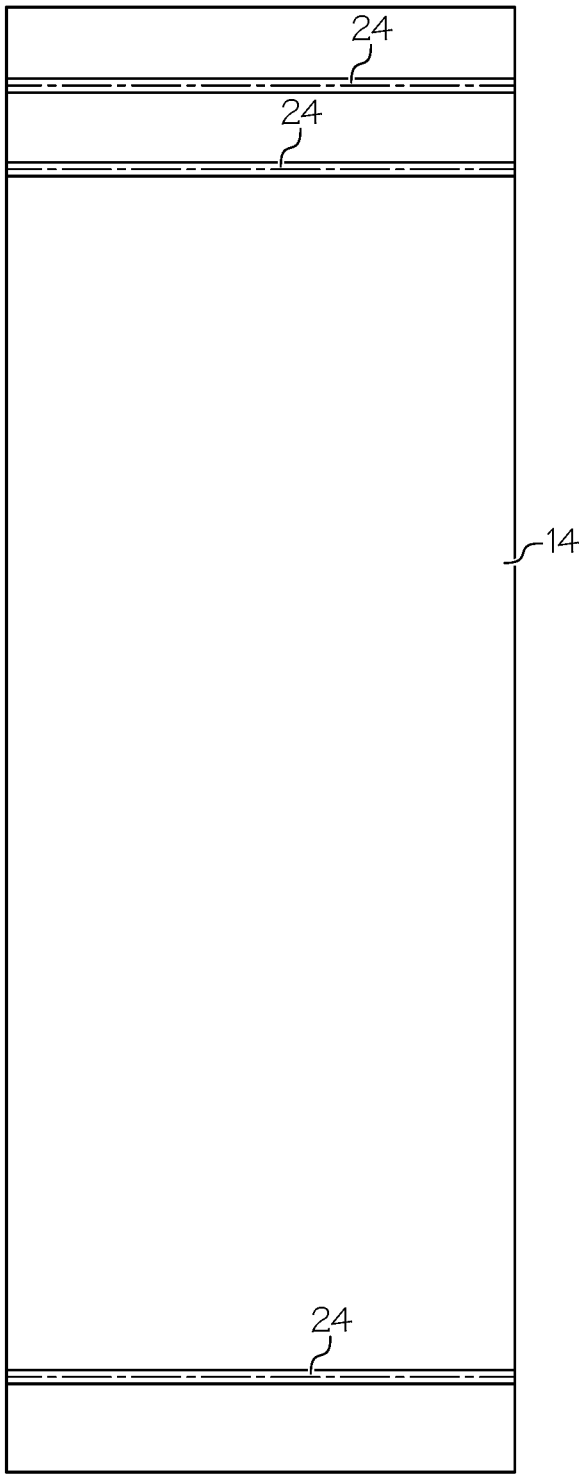
FIG. 16 shows the fold lines necessary to make an intermediate cap from a piece of aluminum.

Referring now to FIGS. 14-16, an intermediate cap 14 is shown, which is made from a sheet of aluminum material which is bent at the numbered fold lines 24 in FIG. 16. Intermediate caps 14 are placed corresponding to intermediate blocks and are made of aluminum or similar sheet metal cut and bent three times (FIG. 16).

Figure 17:
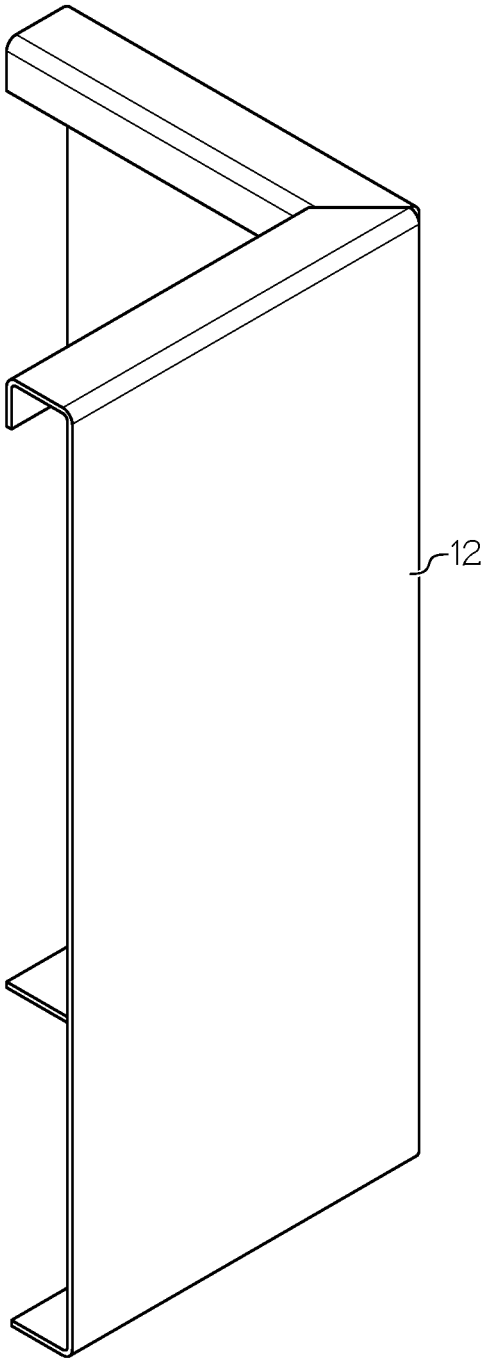
FIG. 17 shows a corner cap.
Figure 18:
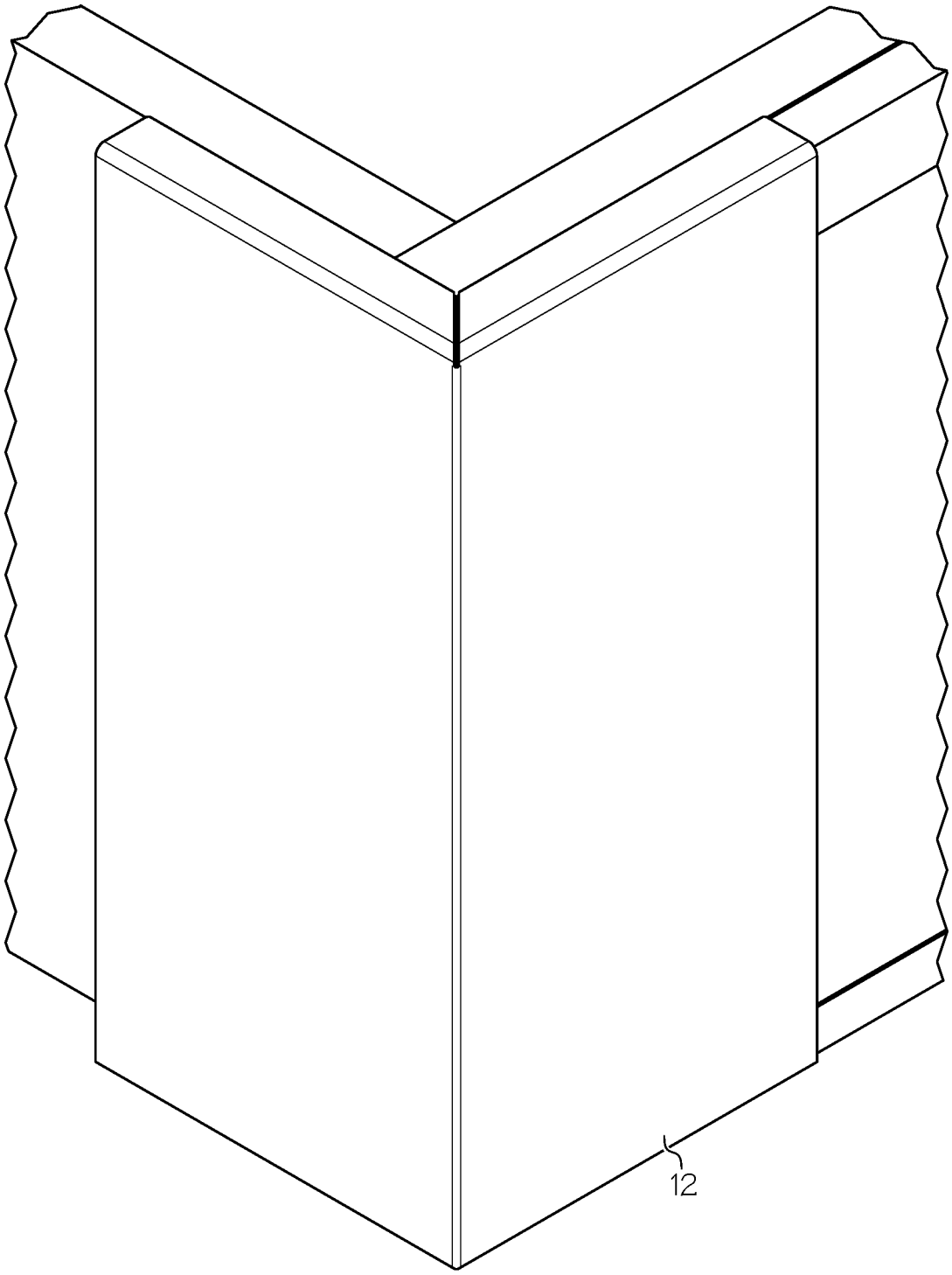
FIG. 18 shows the corner cap snap fitted over the corner block.
Figure 19:
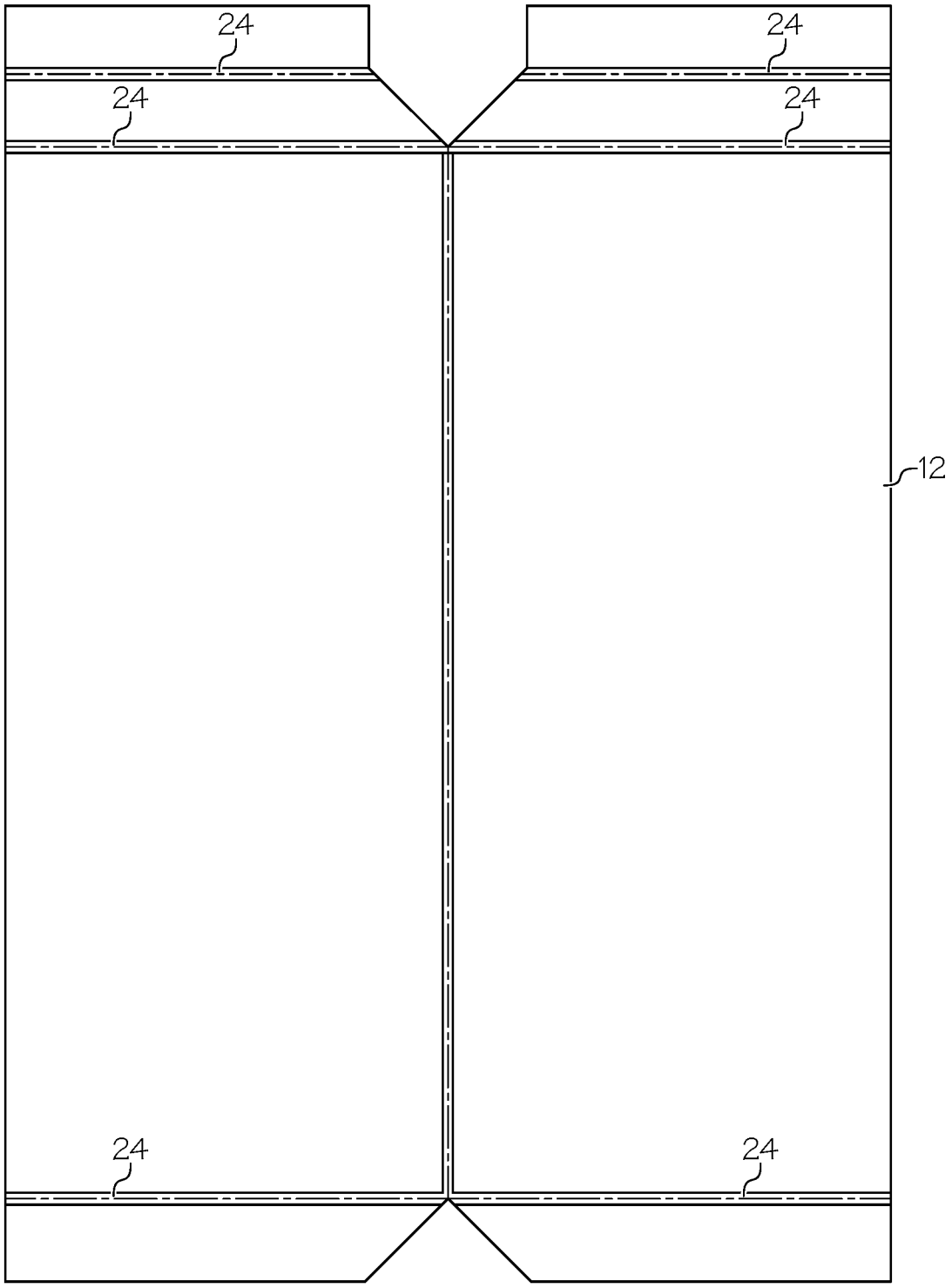
FIG. 19 shows the fold lines necessary to make a corner cap from a piece of aluminum.
Figure 20:
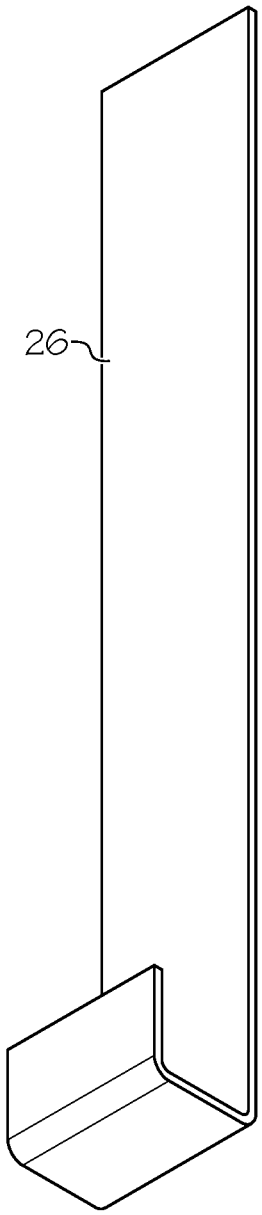
FIG. 20 shows a J hook.
Figure 21:
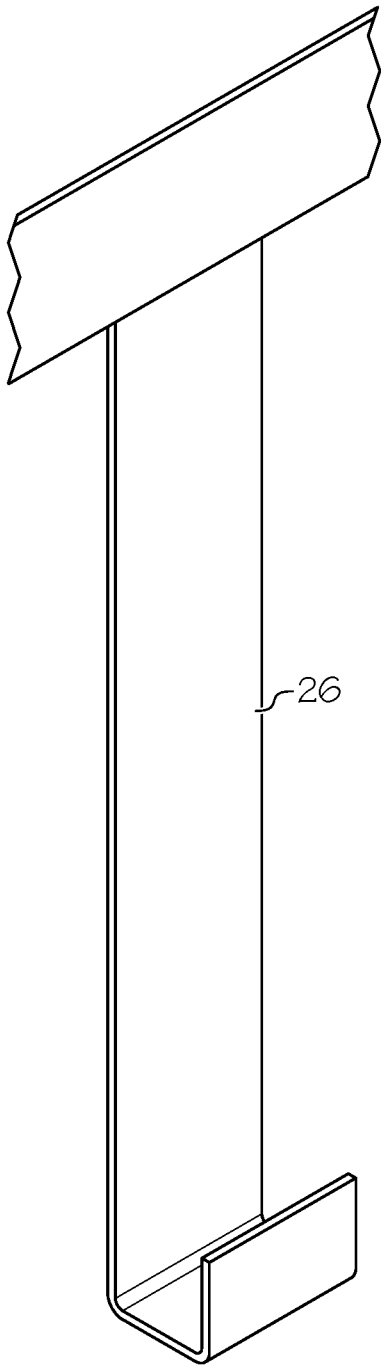
FIG. 21 shows the J hook attached to the framing material.
Figure 22:
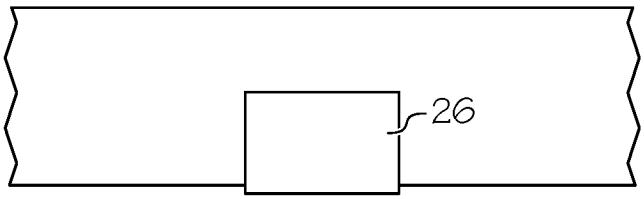
FIG. 22 shows the J hook helping support the lower J channel.

Referring now to FIGS. 17-19, a corner cap 12 is shown, which is made from a sheet of aluminum material which is bent at the numbered fold lines 24 in FIG. 19. Outside corner caps 12 are placed corresponding to the but joint created where two fascia pieces meet at various angles. Corner Caps consist of cut aluminum or similar sheet metal bent seven times (FIG. 19).

Figure 23:
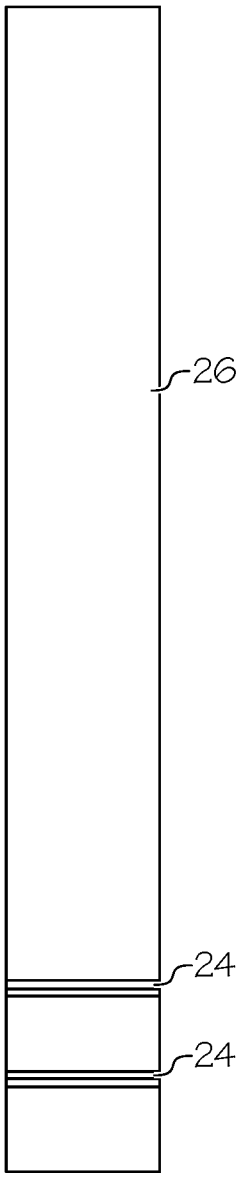
FIG. 23 shows the fold lines necessary to make a J hook from a piece of aluminum.

Referring now to FIGS. 20-23, a J hook 26 is shown, which is made from a sheet of aluminum material which is bent at the numbered fold lines 24 in FIG. 23. J hooks are placed between transition blocks as needed to support the J Channel and Fascia and are made of aluminum or similar sheet metal cut and bent two times (FIG. 23).

The installation process starts by attaching the block hardware (for example a corner block 20 and an intermediate transition block 22) to the framing material 11 using off the shelf hardware appropriate for the materials. Next you attach the upper and lower J channels 16 and 18 to the fascia 10 using off the shelf hardware and slide it into the channels of the blocks (see FIGS. 6 and 9). After the fascia 10 is in place you snap the cap pieces 12 and 14 opposite the blocks 20 and 22 to secure the fascia 10. Finally, you attach J hooks 26 between transition blocks as needed. The J hooks 26 are attached to the framing material between transition blocks prior to sliding the fascia material into the channels of the blocks 20 and 22.

The blocks 20 and 22 are attached to the frame 11 with off the shelf hardware in accordance with the framing material i.e. wood screws, concrete anchors etc. The block is installed with the channels away from the framing and supports the Fascia on the structure. There are corner blocks 20 (FIG. 9) and intermediate blocks 22 (FIG. 6). The intermediate blocks 22 attach to the framing 11 where adjacent fascia boards 10 intersect and can be made from aluminum or similar material. For the creation of the intermediate block sheet metal is bent by machine four times (FIG. 8). The outside Corner Block 20 (see FIGS. 9&10) attached to outside corners and can be made from aluminum and similar materials it consists of sheet metal being cut and bent nine times (FIG. 11).

All caps (12 and 14) are placed analogous to the block hardware 20 and 22 and snap into place over the blocks 20 and 22 to conceal joints and secure the system. Caps are sold as a set with the corresponding block.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of mounting fascia comprising the steps of:

attaching at least two blocks, spaced apart to framing material, the blocks having upper and lower channels facing away from the framing material;

attaching upper and lower J channel[s] to a piece of fascia material and sliding the fascia material with the J channels into the block channels;

snapping caps over the at least two blocks.

2. The method of mounting fascia of claim 1 wherein one of the at least two blocks is a corner block.

3. The method of mounting fascia of claim 1 wherein one of the at least two blocks is an intermediate block.

4. The method of mounting fascia of claim 1 wherein the at least two blocks are made out of metal.

5. The method of mounting fascia of claim 4 wherein the at least two blocks are made out of aluminum.

6. The method of mounting fascia of claim 1 wherein the at least two blocks are made out plastic.

7. The method of mounting fascia of claim 1 wherein the upper and lower J channels are made out of metal.

8. The method of mounting fascia of claim 1 wherein the upper and lower J channels are made out of plastic.

9. The method of mounting fascia of claim 1 wherein the caps are made out of metal.

10. The method of mounting fascia of claim 1 wherein the caps are made out of plastic.

11. The method of mounting fascia of claim 1 wherein one of the caps is a corner cap and one of the caps is an intermediate cap.

12. The method of mounting fascia of claim 1 further including at least one J hook attached to the framing material in between the at least two blocks to provide additional support for the fascia material.

13. A fascia mounting system comprising:

at least two blocks, spaced apart and attached to framing material, the blocks having upper and lower channels facing away from the framing material;

upper and lower J channel[s] attached to a piece of fascia material and which is slid into the block channels;

caps which are snapped fitted over the at least two blocks.

14. The fascia mounting system of claim 13 wherein one of the at least two blocks is a corner block.

15. The fascia mounting system of claim 13 wherein one of the at least two blocks is an intermediate block.

16. The fascia mounting system of claim 13 wherein the at least two blocks are made out of metal.

17. The fascia mounting system of claim 16 wherein the at least two blocks are made out of aluminum.

18. The fascia mounting system of claim 13 wherein the at least two blocks are made out plastic.

19. The fascia mounting system of claim 13 wherein the upper and lower J channels are made out of metal.

20. The fascia mounting system of claim 13 wherein the upper and lower J channels are made out of plastic.

21. The fascia mounting system of claim 13 wherein the caps are made out of metal.

22. The fascia mounting system of claim 13 wherein the caps are made out of plastic.

23. The fascia mounting system of claim 13 wherein one of the caps is a corner cap and one of the caps is an intermediate cap.

24. The fascia mounting system of claim 13 further including at least one J hook attached to the framing material in between the at least two blocks to provide additional support for the fascia material.

* * * * *